US009151514B2

(12) United States Patent
Arnold, III

(10) Patent No.: US 9,151,514 B2
(45) Date of Patent: Oct. 6, 2015

(54) UNIVERSAL CANOPY SUSPENSION SYSTEM

(75) Inventor: Frank Steele Arnold, III, Brookhaven, MS (US)

(73) Assignee: Canopy Breezes, LLC, Madison, MS (US)

( * ) Notice: Subject to any disclaimer, the term of this patent is extended or adjusted under 35 U.S.C. 154(b) by 0 days.

(21) Appl. No.: 13/467,545

(22) Filed: May 9, 2012

(65) Prior Publication Data

US 2012/0286131 A1 Nov. 15, 2012

Related U.S. Application Data

(60) Provisional application No. 61/518,624, filed on May 9, 2011.

(51) Int. Cl.
*E04H 15/10* (2006.01)
*F24F 13/32* (2006.01)
*F24F 7/007* (2006.01)

(52) U.S. Cl.
CPC ..... *F24F 13/32* (2013.01); *F24F 7/007* (2013.01)

(58) Field of Classification Search
USPC ..... 248/345, 342, 343, 344, 288.31; 416/244 R, 5, 246; 403/122; 135/16, 135/96, 120.1, 120.3, 91, 909, 910; 415/213.1
See application file for complete search history.

(56) References Cited

U.S. PATENT DOCUMENTS 1,054,951 A * 3/1913 Wakefield ..... 248/345
1,215,838 A * 2/1917 Negus ..... 362/294
D150,820 S * 9/1948 Anderson ..... D26/143
3,506,232 A * 4/1970 Wolar et al. ..... 248/320
5,069,572 A * 12/1991 Niksic ..... 403/170
5,567,117 A * 10/1996 Gunn et al. ..... 416/244 R
5,591,005 A * 1/1997 McCready ..... 416/62
5,591,006 A * 1/1997 DeMeo et al. ..... 416/62
5,601,409 A * 2/1997 Huang ..... 416/229 R
6,015,261 A * 1/2000 Barone ..... 416/62
6,053,710 A * 4/2000 Chung ..... 417/423.15
6,325,084 B1 * 12/2001 Cohen ..... 135/16
6,397,869 B1 * 6/2002 Jennings ..... 135/93
6,516,823 B1 * 2/2003 Glover et al. ..... 135/94
6,907,894 B1 * 6/2005 Bishop ..... 135/16
6,981,678 B2 * 1/2006 Fu-Liang ..... 248/343
7,056,090 B1 * 6/2006 Stengel ..... 416/62
7,703,466 B1 * 4/2010 Smith ..... 135/91
7,726,945 B2 * 6/2010 Grant et al. ..... 416/134 R
7,836,905 B2 * 11/2010 Tarter et al. ..... 135/91
8,025,481 B2 * 9/2011 Foxworth ..... 416/62
8,221,077 B2 * 7/2012 Pelshak et al. ..... 416/5
(Continued)

*Primary Examiner* — Terrell McKinnon
*Assistant Examiner* — Michael McDuffie
(74) *Attorney, Agent, or Firm* — Craig R. Miles; CR Miles P.C.

(57) ABSTRACT

A suspension system for the attachment of a multiple bladed fan, connected beneath the roof of a canopy-styled tent or other overhead structure. The system's bracket is comprised of multiple arms that universally grip the frame of the said canopy-styled tent or overhead structure. Suspension is not limited to a fan, but also other embodiments, each powered by a plug or battery. The bracket is manufactured in polymer or like material. The system's fan blades are comprised of foam, rubber, or other soft matter. The suspension system allows the fan or other attached embodiment's height to be manipulated by a process further shown in this application. The system further includes embodiments for lighting, heating, or the mounting of additional embodiments. The suspension system and its embodiments are portable and may be broken down into a self-contained bag or case for easy transport.

18 Claims, 19 Drawing Sheets

(56) References Cited

U.S. PATENT DOCUMENTS

2002/0085919 A1* 7/2002 Ross ..... 416/246
2007/0209694 A1* 9/2007 Gooch et al. ..... 135/91
2008/0076379 A1* 3/2008 Li ..... 455/344
2008/0078912 A1* 4/2008 Chen ..... 248/343
2009/0169377 A1* 7/2009 Horng ..... 415/213.1
2010/0282283 A1* 11/2010 Bauer ..... 135/96
2011/0094553 A1* 4/2011 Lah ..... 135/120.3

* cited by examiner

UNIVERSAL CANOPY SUSPENSION SYSTEM

This United States Non-Provisional Patent Application claims the benefit of U.S. Provisional Patent Application No. 61/518,624, filed May 9, 2011, hereby incorporated by reference herein.

FIELD OF THE INVENTION

This application relates to the use of an attachable fan and its embodiments to an outdoor canopy-styled tent.

BACKGROUND OF THE INVENTION

Canopy-styled tents have multiple legs, a roof, and sometimes side walls. They have been used for hundreds of years as shelter; however, they are limited in providing comfort and protection for the individual user from the outdoor elements such as extreme temperatures or poor lighting. Another problem is that some current products do not free up the user to perform other tasks while enjoying the climate-controlled atmosphere.

For example, battery-powered hand-held fans are currently available for purchase. Some of the hand-held fans are inexpensive and safe, yet they do not easily solve this problem.

There are currently free standing fans such as a box-styled fan or an industrial fan that can be used with tents; however, they are noisy and cumbersome to deal with. These fans also are level with the user and do not provide top-down air flow.

Another available option is a pedestal fan. These fans are heavy and hard to transport and get in the way of the user's activities.

There are also attachable tent fans on the market, but they are either small and do not provide adequate air flow or larger in size but too heavy to be installed on smaller canopy-styled tents with thin poles. Although tent companies may be able to set up for large events and use these large tent fans, most of the types of individually-owned canopy-styled tents are small and use thin poles that cannot support the weight of these large attachable fans. These types of fans also, because of their weight and size, cannot be connected to a pole that is not level due to the slope of the ground in which is erected. This limits the use of these types of fans.

Another problem with the above-mentioned fan options is the material in which they are made. The fans use either plastic or metal blades. This makes these fans dangerous in use and non-weather resistant.

The issue of cleaning is also difficult with box and industrial fans. Sometimes, a screwdriver is needed to open the grill of a box or commercial fan to properly clean dust and grime collected during operation. This can be dangerous and the risk of shock exists.

The weight of these attachable fans to the ceiling of a canopy-styled tent makes it risky to attempt attaching.

In addition, most ceiling fan blades are constructed of wood, plastic, or metal and can be very dangerous if a user came into contact with a spinning blade.

All canopy tents are not created alike. There is the issue of height adjustment that must be taken into consideration for proper air circulation and safety. If a ceiling fan was put in a canopy tent, and the like structures, adjustment of fans height would be difficult. These units are stationary once installed and cannot travel from place to place and be quickly set up for use. Attaching a fan or an apparatus to hold it in position beneath a canopy tent is an issue. Lastly, these fans are just that, only a fan. There is no way to interchange the components of any of these fans to provide lighting or heating within the same attachable system. Separate products would have to be purchased.

SUMMARY OF THE INVENTION

A broad object of a particular embodiment of the invention can be to provide a suspension system including a bracket comprising: a base having a base internal surface opposite a base external surface; a hole defining a hole opening communicating between the base internal and external surfaces; and a plurality of elongate arms extending radially outward from the base, each elongate arm including an upwardly extending coupler directly connected to the elongate arm, the upwardly extending coupler configured to couple to a pole which supports a canopy. The suspension system further includes a downrod having opposing downrod first and second ends; the downrod first end configured to couple to the base proximate the base internal surface when the downrod second end passes through the hole opening; the downrod second end configured to couple to an auxiliary element.

Naturally, further objects of the invention are disclosed throughout other areas of the specification, drawings, and claims.

NUMERICAL INDICATOR KEY

Figure 1:
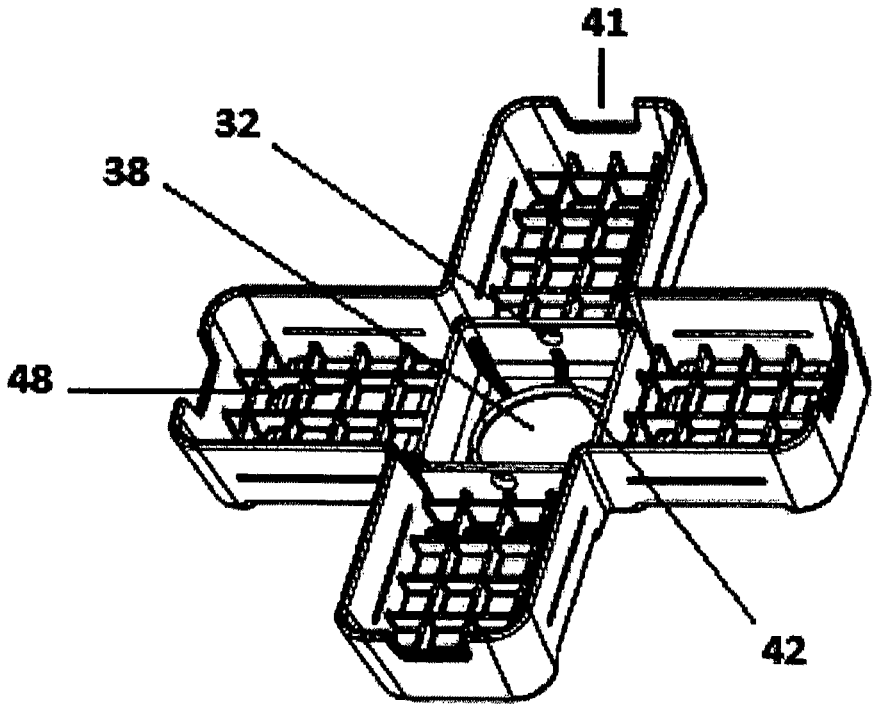
FIG. 1 is a top perspective view of a particular embodiment of a bracket of the suspension system.

18 extension pole for height adjustment
20 motor housing unit's universal female cap, connects to extension pole or directly to the downrod
22 extension pole's hole for the double locking button snap, attaches to downrod or pin and clip with a ceiling plug
23 hole in motor housing unit's female cap for double locking button snap, pin and clip, or other locking mechanism
25 downrod's hole(s) at the base of ball joint that allows double locking button snaps to connect directly to an attachment pole or to the female cap of fan, light, or heater
26 attachment bracket
28 "soft to the touch" blade made from flexible foam and latex or similar materials that allows shaping and bending without breaking
32 attachment bracket's hole for security pin insertion
33 security pin and clip (clip not shown) inserted through the ball joint and downrod of attachment bracket
34 upper housing unit for motor
38 downrod's oval hole
39 cut out to allow swinging of downrod without intrusion against the canopy tent's upper poles
40 downrod (male part) that connects to motor housing unit, optional light, optional heater, or extension pole
41 attachment bracket arm's U-shaped cut outs offering a closer fit to the canopy tent's poles
42 support ridges around oval downrod hole, adds structural integrity when fan, light, or heater is attached
43 security pin hole for additional safety; security pin goes through bracket and ball joint and locks with pin
44 attachment's indentions or track to keep hook and loop straps from shifting
45 interior downrod integrity ribs
48 attachment bracket's "waffle" ribs for structural integrity
52 cutouts for hook and loop straps or similar material for connection to the canopy tent's poles
54 base fan can be flat or has lighting capabilities with, LED, florescent, or similar lighting devices
56 fan's blade wheel; note: no protruding screws or an edge in case the user makes contact with the blade
58 fan, light, or heater power source if not using battery
60 plug allows fan, light, or heater to connect elsewhere than a canopy tent; use of plug, eyehook, and a d-ring (see FIG.

12) allows a properly functioning fan if hung from a level or sloped pole, tree limb, ceiling, rafter, etc.

62 plug's eyehook

70 optional light

72 optional light with round florescent bulb, or like mechanisms

73 optional light's female cap for connection to either extension pole or directly to the attachment bracket

74 florescent bulb ballast

75 hole in female cap for double button lock, pin and clip, and similar mechanism

76 optional light with LED bulbs or like mechanisms

77 globe or cover for the optional lighting system; can also be flush with no electronics

78 light's on/off switch; many switch options are available

80 fan's dial or knob notification dot

82 back view of dial or knob

84 notification dots

86 fan or light dial, there are many options for knob design

87 optional heating system

88 protective grill over heating element

89 optional heating system's upper female cap for connection to extension pole or directly to attachment bracket's downrod

90 optional heating system's female cap hole for double button snap, pin and clip, or similar mechanism

92 remote control

94 hinge

96 optional hook attachments

DETAILED DESCRIPTION OF THE INVENTION

The advantage of the Universal Canopy Suspension System is that it provides comfort to the user of any canopy-styled tent from the outdoor elements (cold temperatures, hot temperatures or darkness) with ease and simplicity.

This system provides the user with the ability to perform other activities while enjoying a climate-controlled environment. The system is easy to transport, going from an easy-to-tote bag to installation in minutes. It is not heavy but large enough to provide adequate top-down airflow or evenly distributed heat as well as plentiful lighting. The suspension system is able to provide lighting and heating instead of or in combination with the fan. Its blades for the fan are made of foam, or like materials which make it safe, durable, and weather resistant. A latex dipping process keeps the blades stiffer which provide better air flow. The blades are not limited to foam with a latex cover, similar production options also include injection molding and sprayed on finishes.

The Universal Canopy Suspension System and its embodiments also function properly and easily attach to the largest canopy-styled tents as well as those smaller canopy-styled tents with thin poles that are used for recreational purposes, even if the ground on which the canopy-styled tent is to be erected is uneven. It is quiet and out-of-the-way of the participants, freeing them to enjoy activities with comfort and convenience.

The Universal Canopy Suspension System also has the ability to be manufactured and shipped to the user complete with their blade color of choice. Further, the user has the ability to order and change his/her blades without compromising the fan's weather resistant characteristic. This method of exchange will be safe, simple, and quick. This will also give the user the ability to replace a damaged blade.

Another advantage of the Universal Canopy Suspension System is simple cleaning. By quickly removing the fan from the canopy pole(s), a user is in a better position to clean the fan safely and efficiently. A damp rag across the entire surface of the fan can be quickly performed after each use. Having the ability to unplug the fan from its power source prior to cleaning alleviates the risk of shock.

The extra step of ladders and other means for removing the suspension system can be avoided by the ability of some canopy-styled tents to adjust its leg length to lower its canopy or roof can also be avoided.

Screwdrivers or similar devices used for the removing of a fan's cover to clean is also avoided with the Universal Canopy Suspension System. The latex, or like material, covering the blades prevents dirt and fingerprints from embedding to the porous blade's surface. As to particular embodiments, the Universal Canopy Suspension System and its embodiments can be battery powered. Types of batteries to meet our needs of RPMs and extended battery life are available on the market.

The first step in using the Universal Canopy Suspension System is to find a canopy-styled tent where a user of the system and its embodiments would benefit. Useful canopy-styled tents include 10'×10' and 20'×10' pull-out and pop-up, or collapsible canopy-styled tents with 4 or 6 adjustable legs. However, the Universal Canopy Suspension System's attachment bracket can connect to larger canopy-styled tents with fixed multiple legs.

After the canopy-styled tent's canopy or cover is up and fully expanded, the user may begin the Universal Canopy Suspension System's set up.

Figure 2:
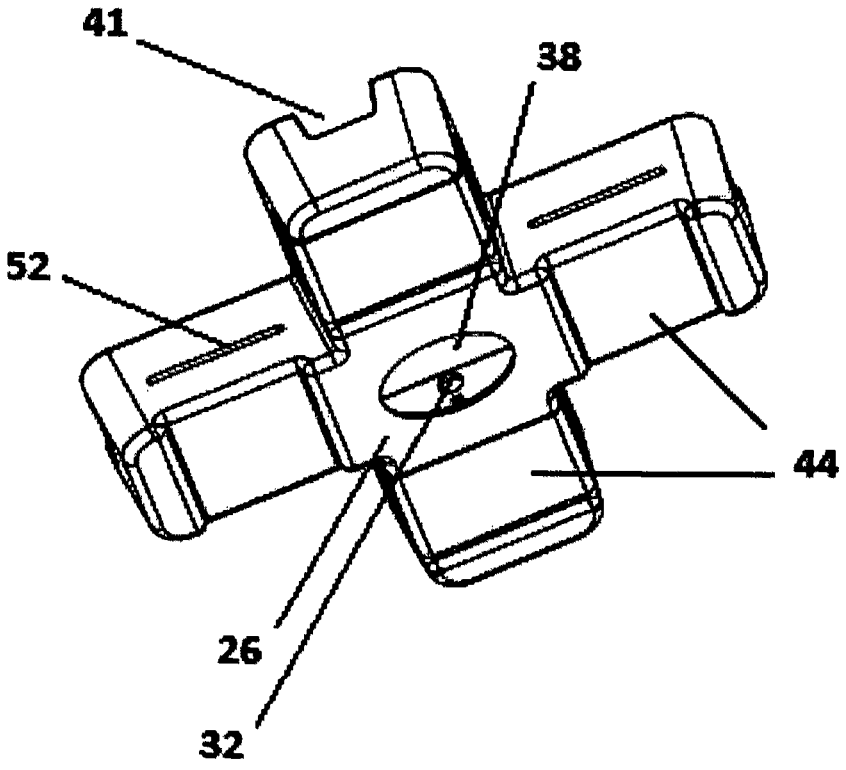
FIG. 2 a bottom perspective view of a particular embodiment of a bracket of the suspension system.
Figure 3:
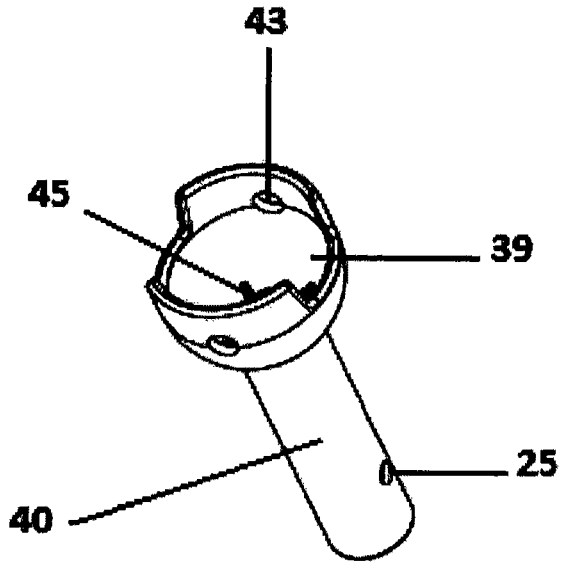
FIG. 3 is a top perspective view of a particular embodiment of a downrod of the suspension system.
Figure 4:
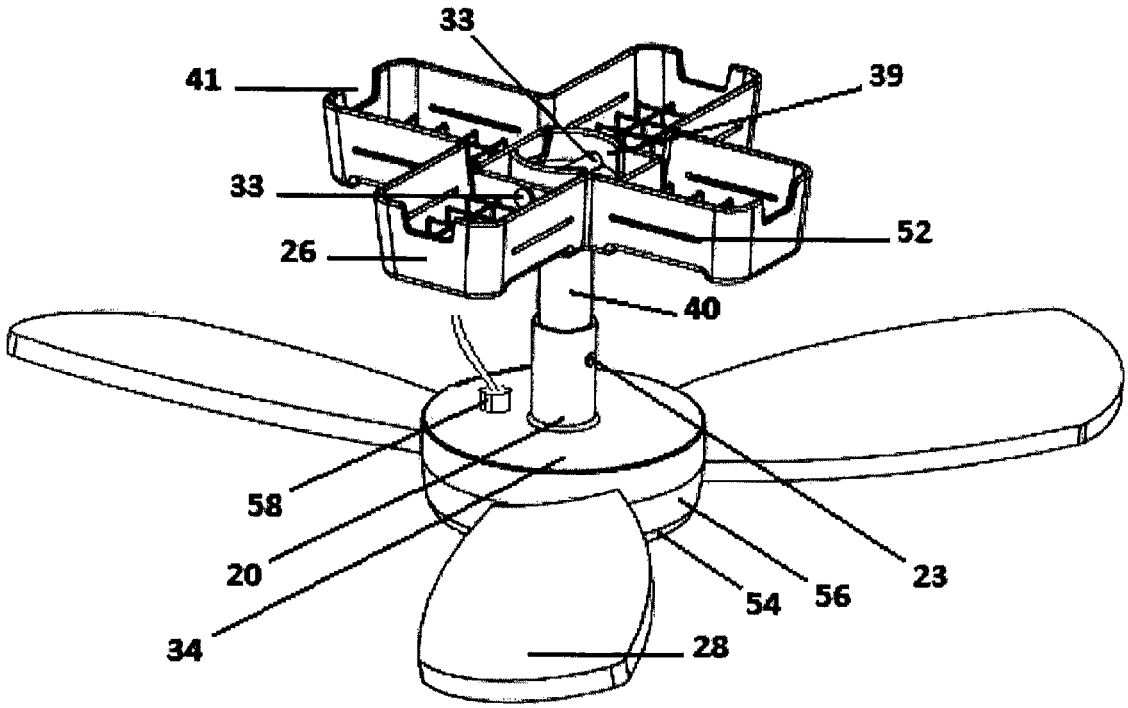
FIG. 4 is a perspective view of a particular embodiment of the suspension system coupled to an auxiliary element comprising a fan.
Figure 5:
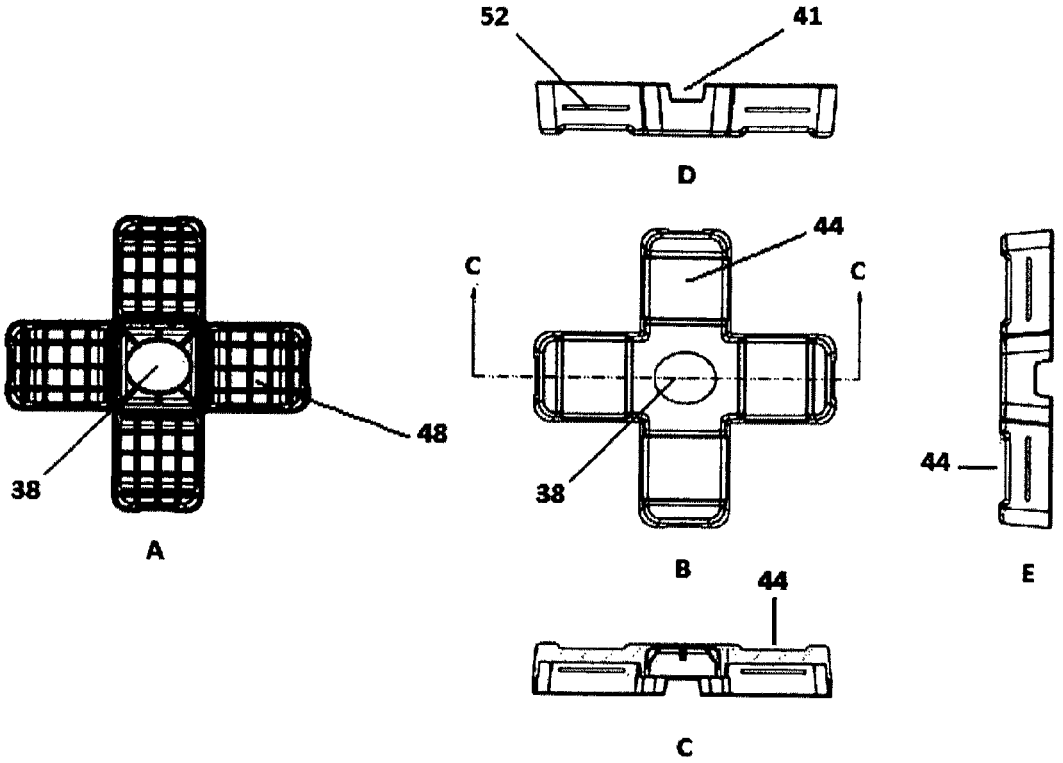
FIG. 5A is a top view of a particular embodiment of a bracket of the suspension system.
FIG. 5B is a bottom view of a particular embodiment of a bracket of the suspension system.
FIG. 5C is a cross-sectional view of the particular embodiment of the bracket shown in FIG. 5B.
FIG. 5D is a side view of a particular embodiment of a bracket of the suspension system.
FIG. 5E is a side view of a particular embodiment of a bracket of the suspension system.
Figure 6:
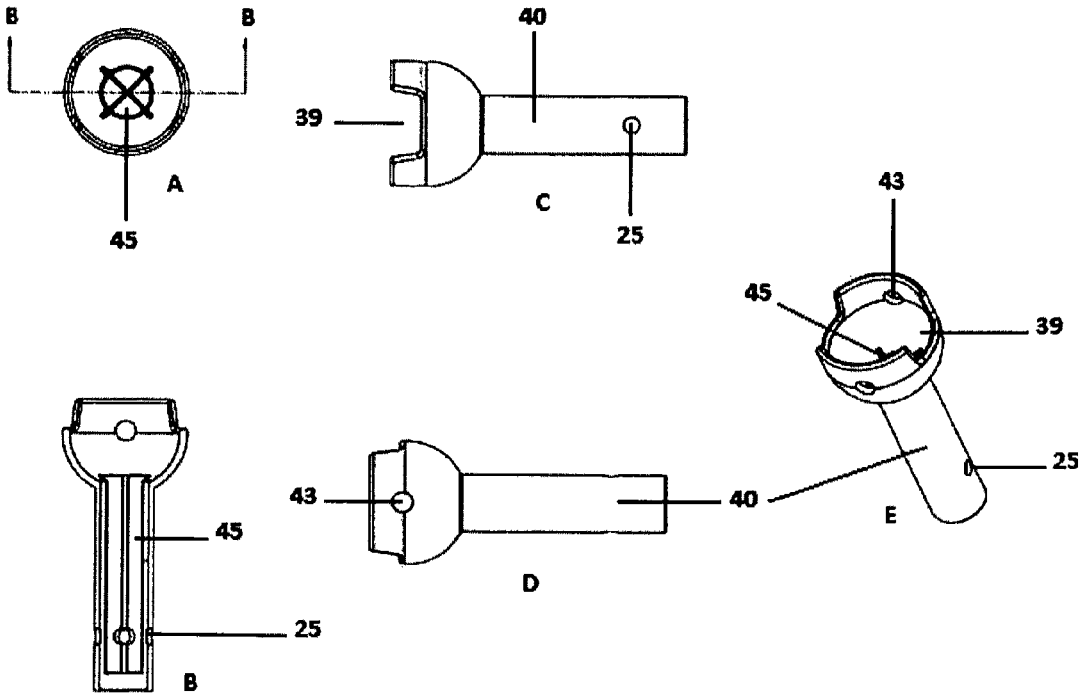
FIG. 6A is a top view of a particular embodiment of a downrod of the suspension system.
FIG. 6B is a cross-sectional view of a particular embodiment of the downrod shown in FIG. 6A.
FIG. 6C is a side view of a particular embodiment of a downrod of the suspension system.
FIG. 6D is a side view of a particular embodiment of a downrod of the suspension system.
FIG. 6E is a top perspective view of a particular embodiment of a downrod of the suspension system.
Figure 7:
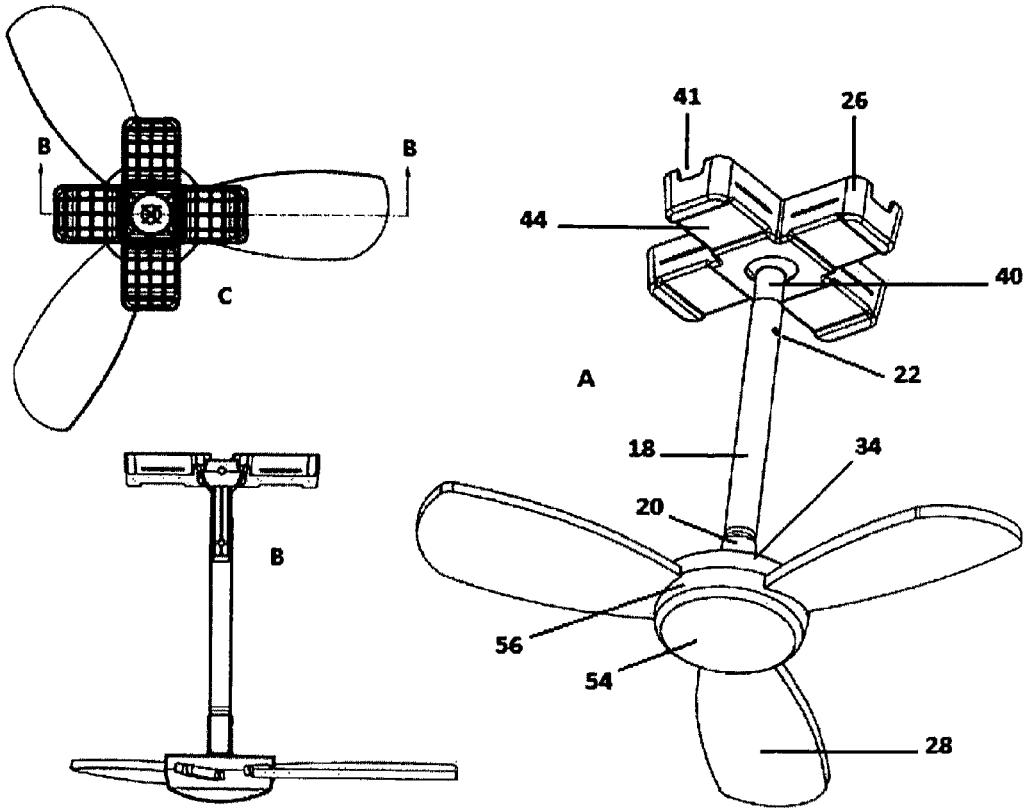
FIG. 7A is a bottom perspective view of a particular embodiment of the suspension system coupled to an auxiliary element comprising a fan.
FIG. 7B is a cross-sectional view of the particular embodiment of the suspension system shown in FIG. 7C.
FIG. 7C is a top view of a particular embodiment of the suspension system coupled to an auxiliary element comprising a fan.
Figure 8:
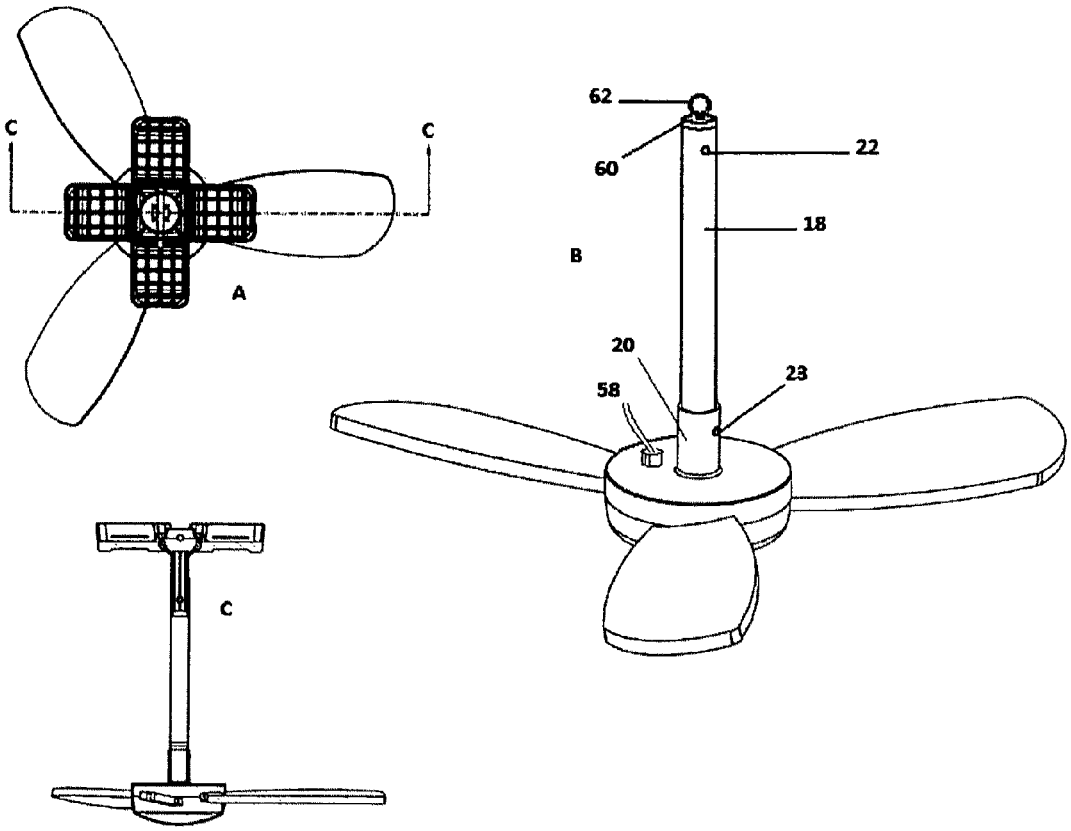
FIG. 8A is a top view of a particular embodiment of the suspension system coupled to an auxiliary element comprising a fan.
FIG. 8B is a top view of a particular embodiment of the suspension system coupled to an auxiliary element comprising a fan.
FIG. 8C is a cross-sectional view of a particular embodiment of the suspension system shown in FIG. 8A.
Figure 9:
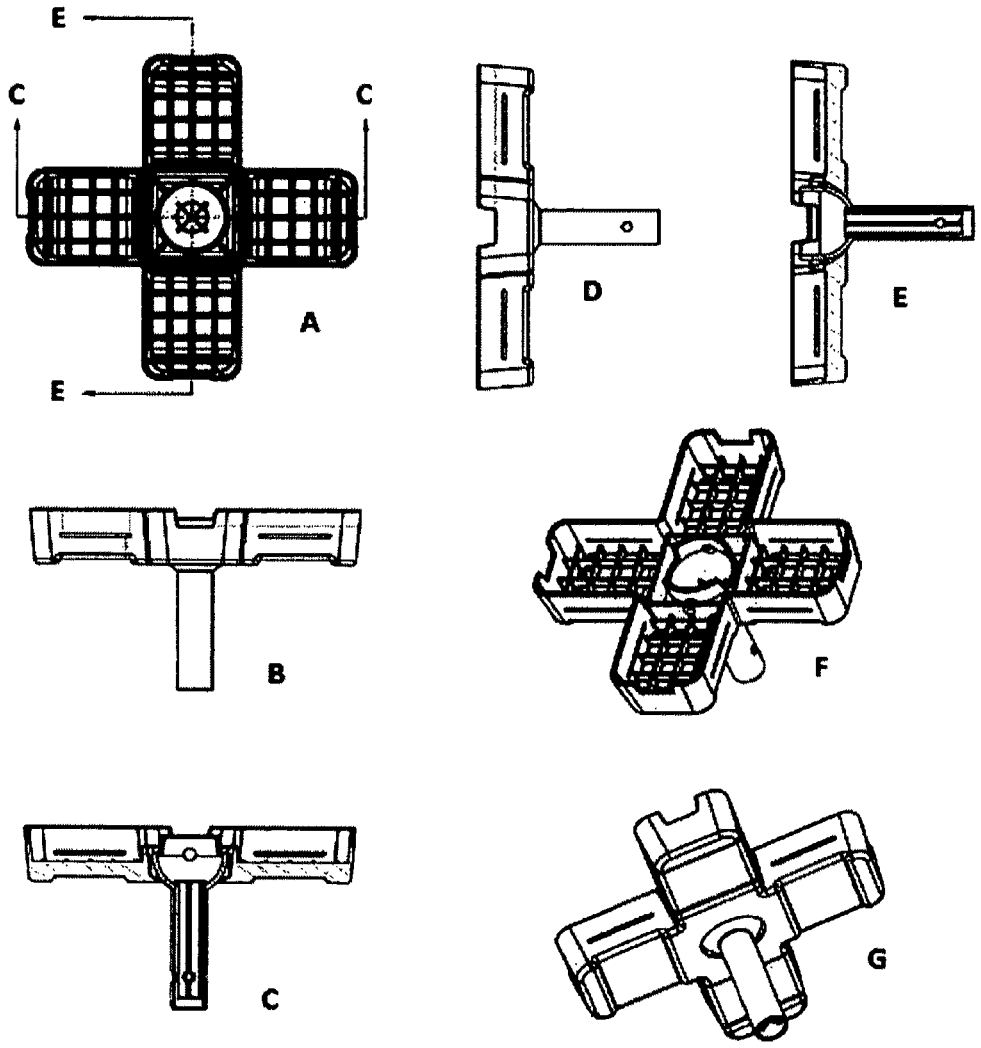
FIG. 9A is a top view of a particular embodiment of a bracket and a downrod of the suspension system.
FIG. 9B is a side view of a particular embodiment of a bracket and a downrod of the suspension system.
FIG. 9C is a cross-sectional view of the particular embodiment of the bracket and downrod shown in Figure 9A.
FIG. 9D is a side view of a particular embodiment of a bracket and a downrod of the suspension system.
FIG. 9E is a cross-sectional view of the particular embodiment of the bracket and downrod shown in FIG. 9A.
FIG. 9F is a top perspective view of a particular embodiment of a bracket and a downrod of the suspension system.
FIG. 9G is a bottom perspective view of a particular embodiment of a bracket and a downrod of the suspension system.
Figure 10:
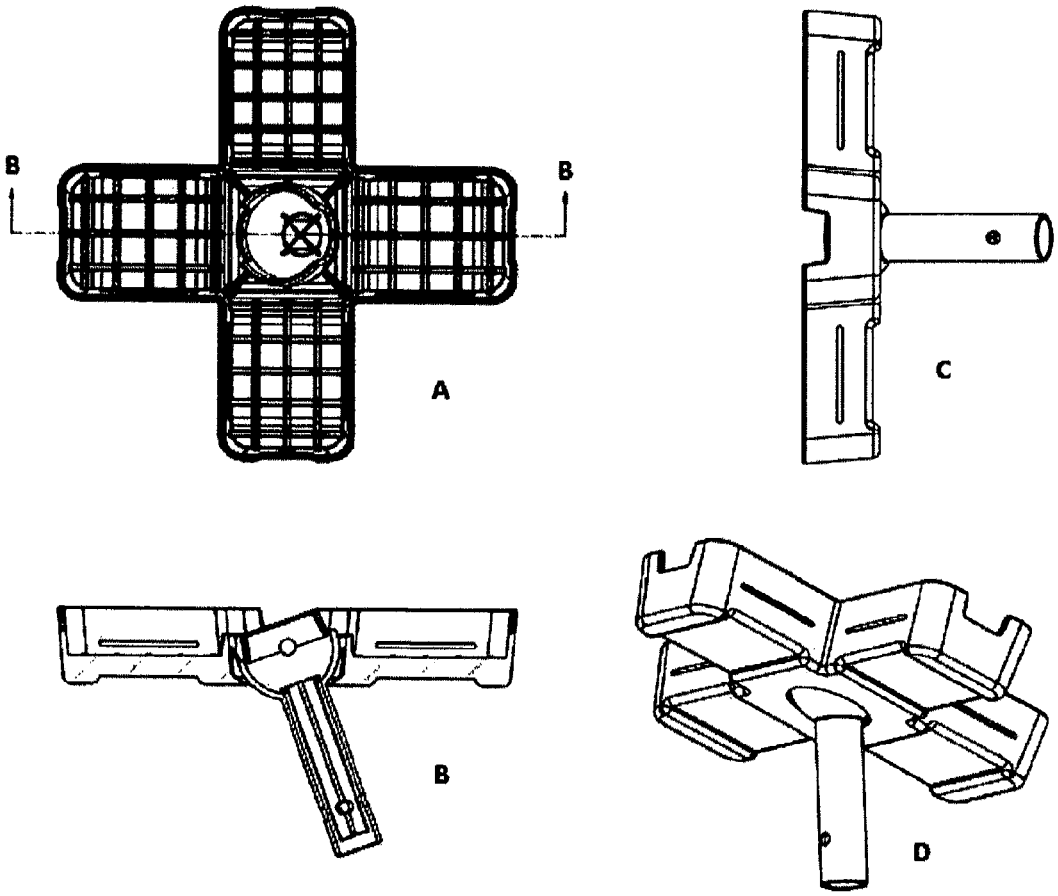
FIG. 10A is a top view of a particular embodiment of a bracket and a downrod of the suspension system.
FIG. 10B is a cross-sectional view of the particular embodiment of the bracket and downrod shown in FIG. 10A.
FIG. 10C is a side view of a particular embodiment of a bracket and a downrod of the suspension system.
FIG. 10D is a bottom perspective view of a particular embodiment of a bracket and a downrod of the suspension system.
Figure 11:
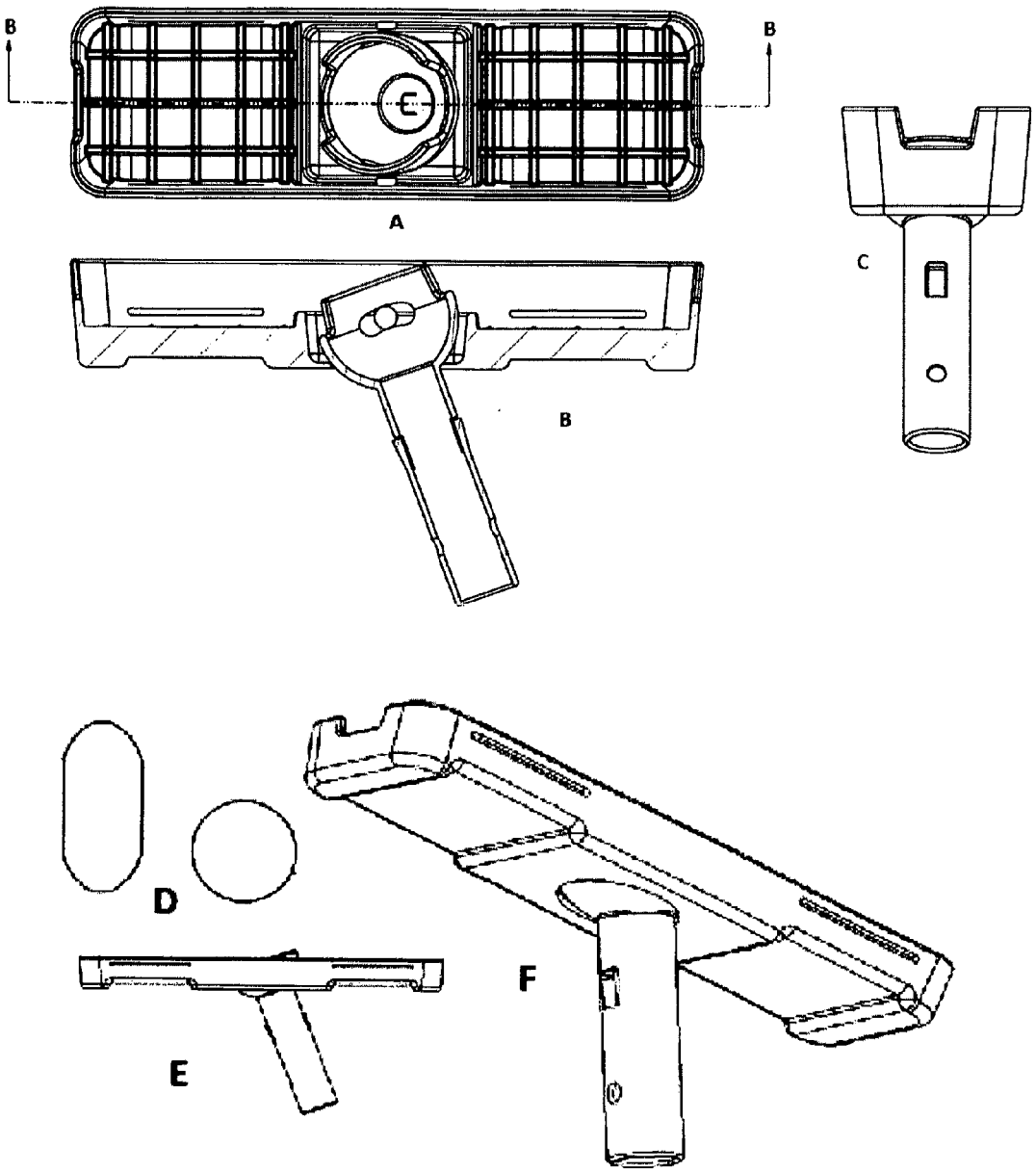
FIG. 11A is a top view of a particular embodiment of a bracket and a downrod of the suspension system.
FIG. 11B is a cross-sectional view of the particular embodiment of the bracket and downrod shown in FIG. 11A.
FIG. 11C is a side view of a particular embodiment of a bracket and a downrod of the suspension system.
FIG. 11D is a view of a particular embodiment of a bracket and a downrod of the suspension system.
FIG. 11E is a side view of a particular embodiment of a bracket and a downrod of the suspension system.
FIG. 11F is a bottom perspective view of a particular embodiment of a bracket and a downrod of the suspension system.
Figure 12:
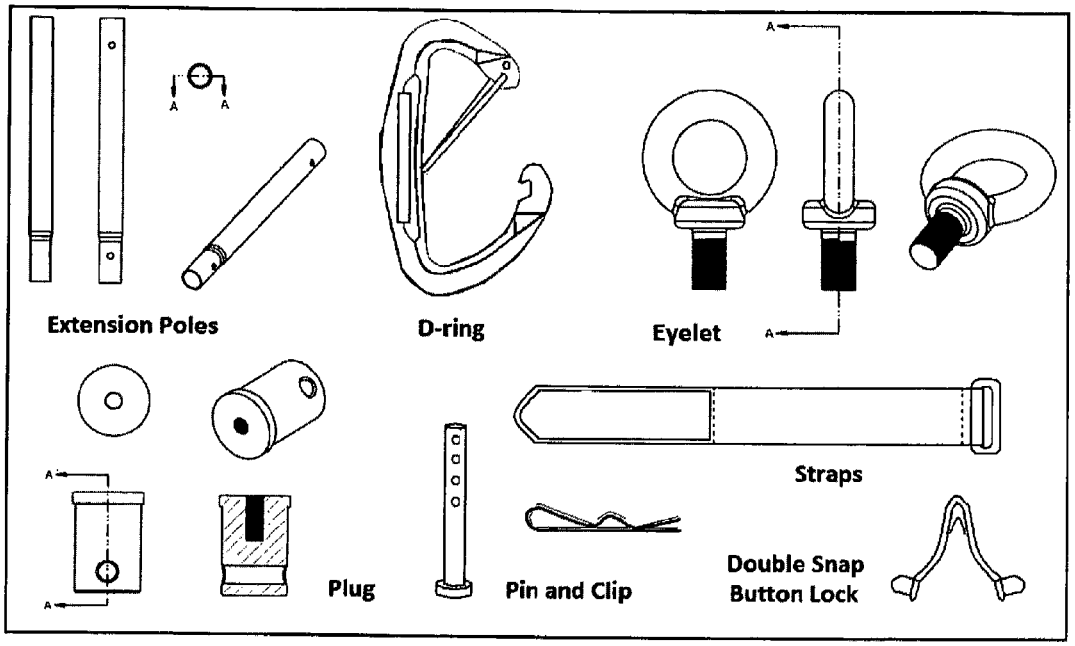
FIG. 12 is an illustration of a plurality of elements which may be useful with a particular embodiment of the suspension system.
Figure 13:
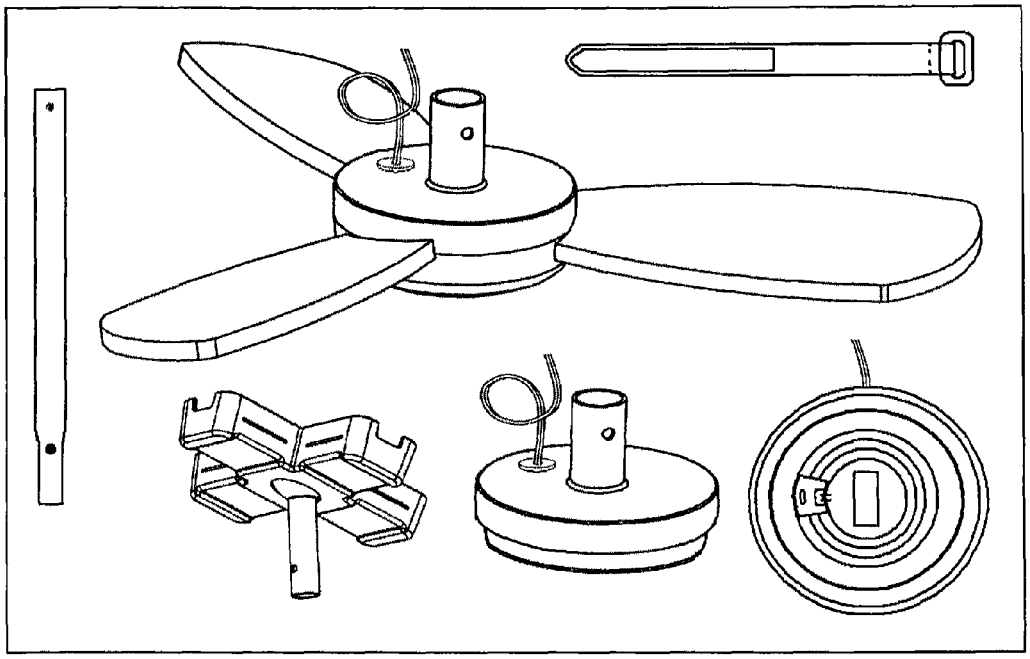
FIG. 13 is a perspective view of particular embodiments of the suspension system.
Figure 14:
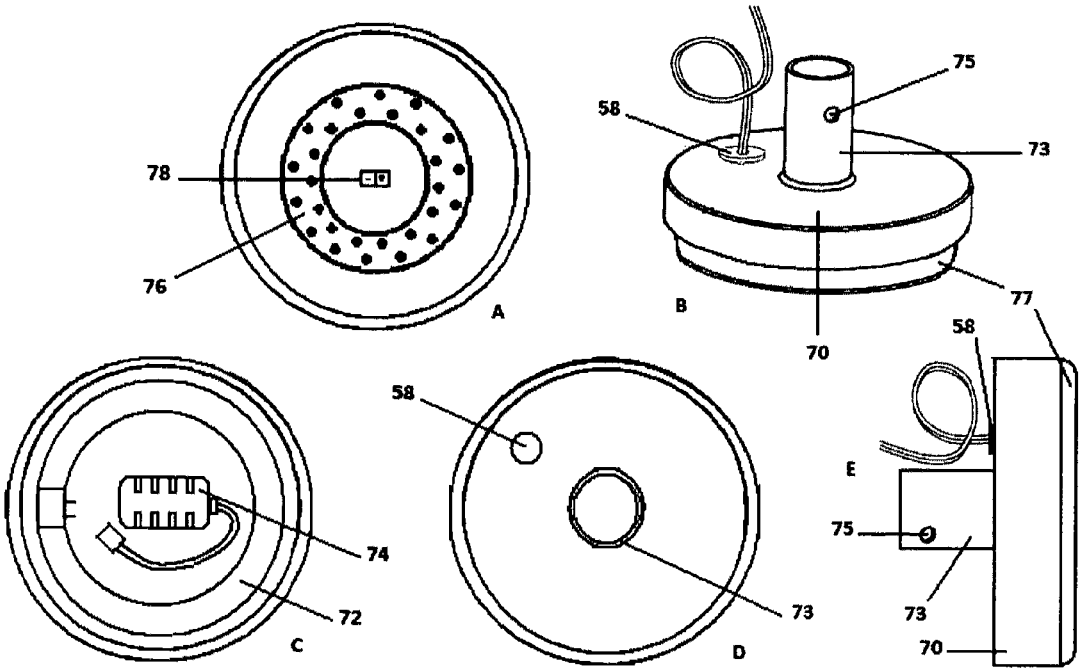
FIG. 14A is a view of a particular embodiment of an auxiliary element comprising a light which may be coupled to a particular embodiment of the suspension system.
FIG. 14B is a view of a particular embodiment of an auxiliary element comprising a light which may be coupled to a particular embodiment of the suspension system.
FIG. 14C is a view of a particular embodiment of an auxiliary element comprising a light which may be coupled to a particular embodiment of the suspension system.
FIG. 14D is a view of a particular embodiment of an auxiliary element comprising a light which may be coupled to a particular embodiment of the suspension system.
FIG. 14E is a view of a particular embodiment of an auxiliary element comprising a light which may be coupled to a particular embodiment of the suspension system.
Figure 15:
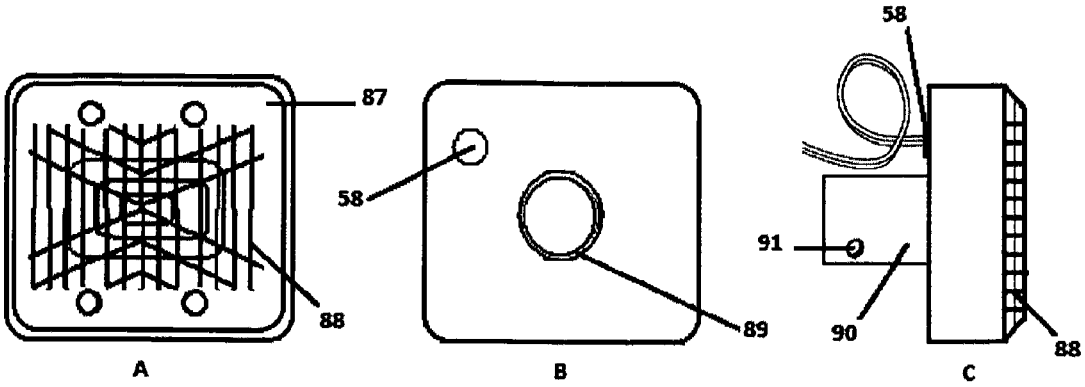
FIG. 15A is a view of a particular embodiment of an auxiliary element comprising a heater which may be coupled to a particular embodiment of the suspension system.
FIG. 15B is a view of a particular embodiment of an auxiliary element comprising a heater which may be coupled to a particular embodiment of the suspension system.
FIG. 15C is a view of a particular embodiment of an auxiliary element comprising a heater which may be coupled to a particular embodiment of the suspension system.
Figure 16:
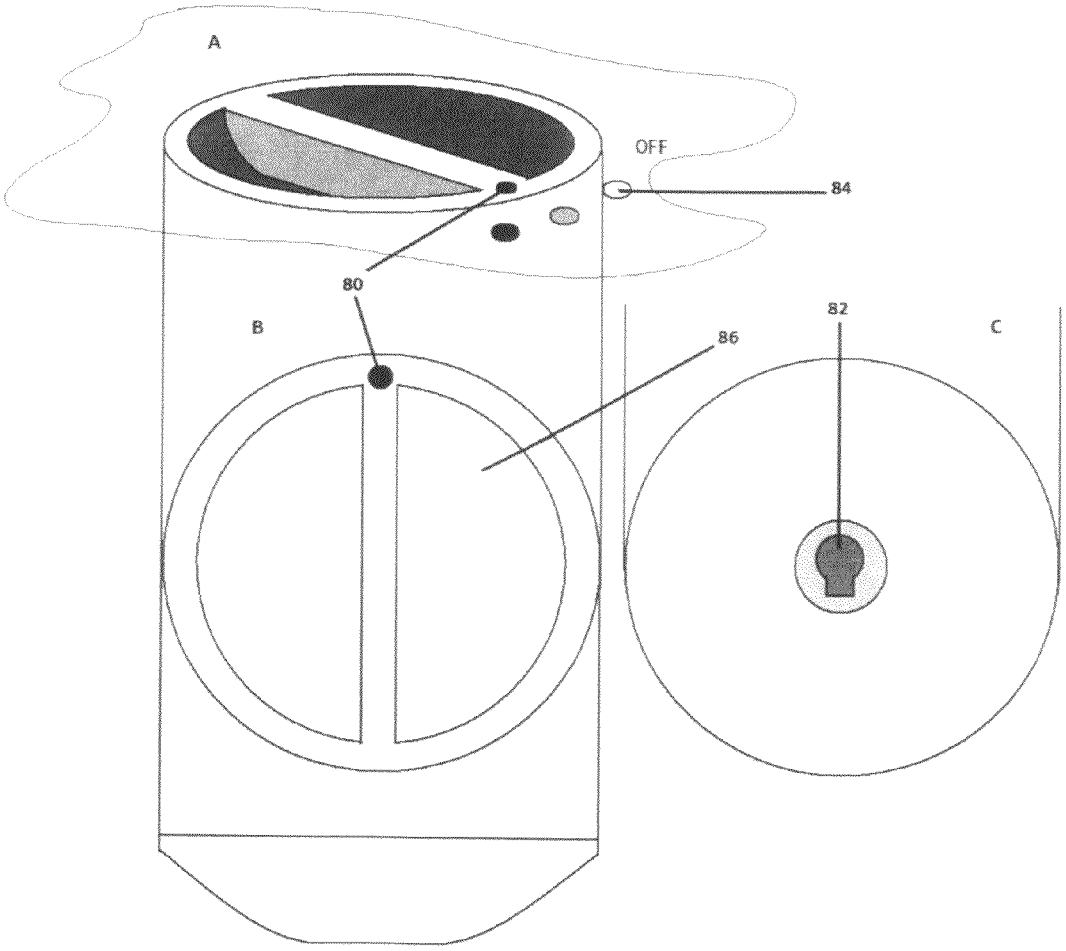
FIG. 16A is a view of a dial which may be useful with a particular embodiment of the suspension system.
FIG. 16B is a view of a dial which may be useful with a particular embodiment of the suspension system.
FIG. 16C is a view of a dial which may be useful with a particular embodiment of the suspension system.
Figure 17:
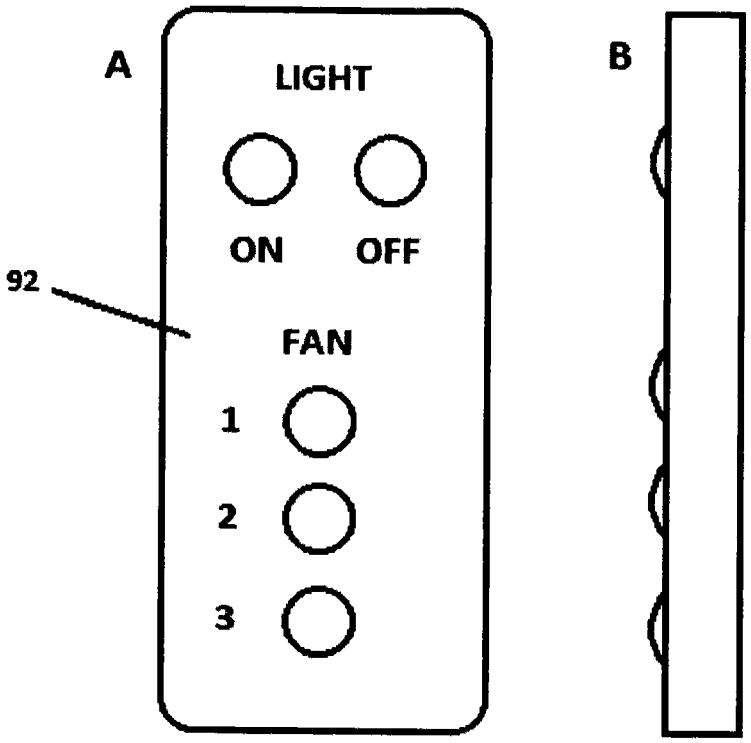
FIG. 17A is a view of a remote which may be useful with a particular embodiment of the suspension system.
FIG. 17B is a view of a remote which may be useful with a particular embodiment of the suspension system.
Figure 18:
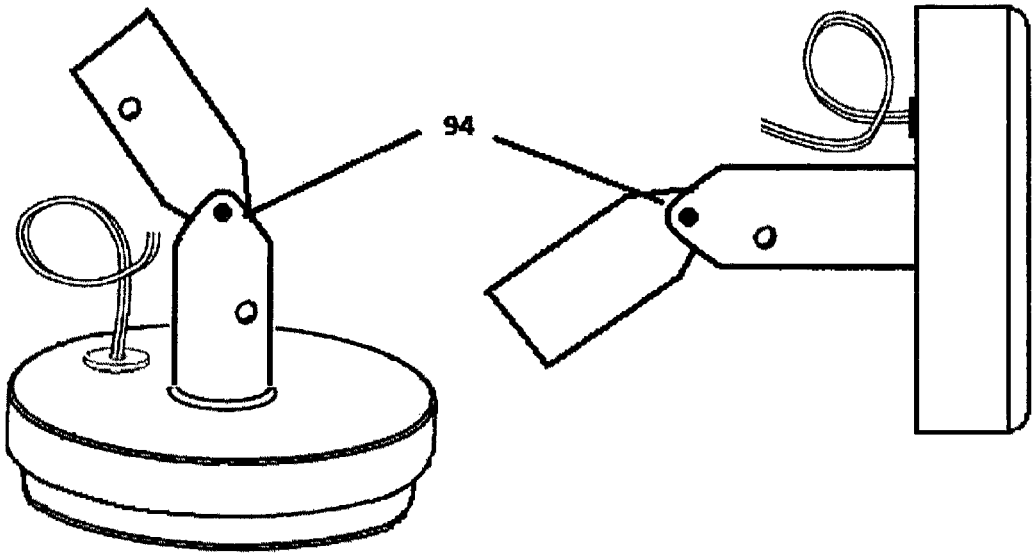
FIG. 18 is a view of a hinge which may be useful with a particular embodiment of the suspension system.

An embodiment needed for the Universal Canopy Suspension System's fan, light, or heating connection is an attachment bracket 26, as illustrated in FIG. 1 (a top view) and FIG. 2 (a bottom view). This attachment bracket consists of multiple arms and is manufactured by polymer or like material. The bracket is lightweight, but strong. Its integrity is enhanced by waffle-patterned 48 reinforcement ridges arms.

The bracket 26 has an oval hole 38 cut out at its base. This hole is designed to hold a downrod 40 that can connect to a fan 34, light 70, heater 97, television mounting system, extension pole 18, and additional connecting embodiments.

Figure 19:
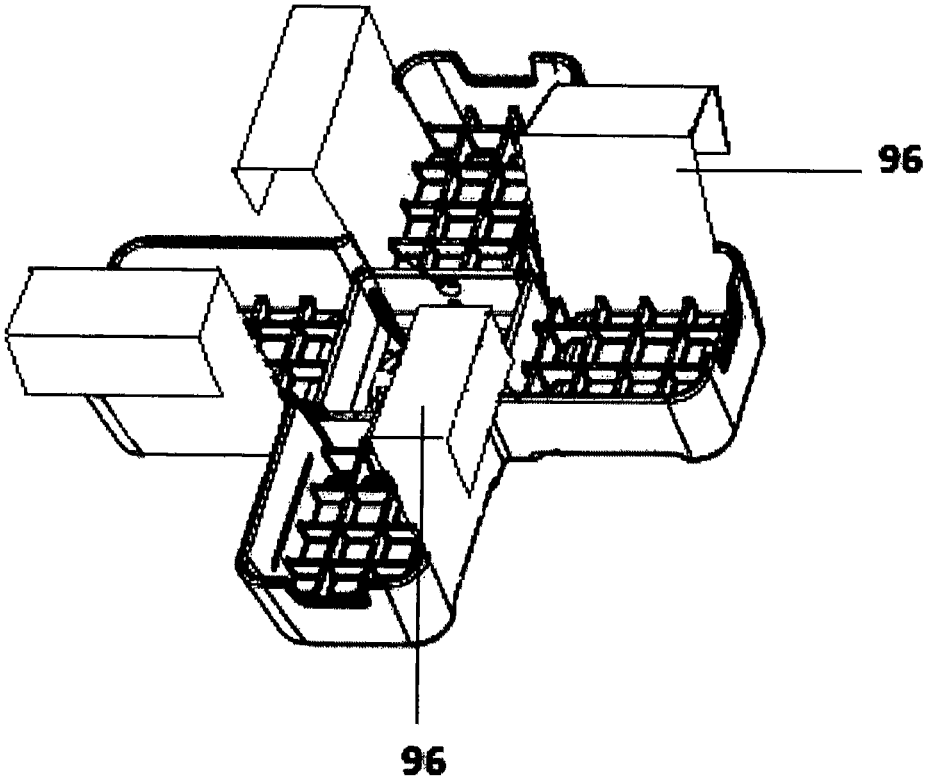
FIG. 19 is a top perspective view of a particular embodiment of a bracket of the suspension system, whereby each elongate arm of the bracket includes a coupler configured as an arm hook upwardly extending from the elongate arm.

The bracket 26 can either be attached with hook and loop straps threaded through the arm slits 52, attached with arm hooks seen in FIG. 19, or attached in other similar methods.

Once the downrod 40 is inserted into the oval hole 38, a pin 33 can be threaded through the holes in the attachment bracket 32 and the holes 43 in the downrod 40, and locked into place with a pin/clip.

Each arm of the bracket needs to be prepared for attachment to the tent pole(s). Therefore, the user must thread each of the hook and loop straps through the slits in each arm of the bracket. At this point, the attachment bracket 26 is pushed up towards and against the tent's canopy poles, whereby the canopy poles lie within the u-shaped cut outs 41 for a tighter and closer connection. With the hook and loop straps, the bracket 26 to the canopy's poles.

Once the bracket 26 is attached, the downrod 40 is ready to connect to a number of embodiments: a fan 34, an optional light 70, a heater 87, extension pole 18, or future embodiments.

The fan 34 connects to the downrod 40 by incursion of the downrod 40 into the top female cap of the fan 23 and locked into place with a double button snap. To decrease the height of the fan, an extension pole 18 can be attached between the downrod 40 and the female cap 20 on top of the fan.

The blades 28 of the fan 34 are made of shaped foam dipped in latex. The blades 28, attached to a blade wheel 56, are thick enough and rigid enough to keep their shape and provide efficient airflow.

The base 54 of the fan 23 can also have a light. The fan and light can be controlled via the remote control 92. This and additional embodiments are powered by normal extension cords or socket 58 or by an optional battery.

The attachment bracket 26 can also connect to an optional light 70 via the same attachment process, however the downrod 40 will connect to an extension pole 18 or directly into the female cap 73 located on the top of the light.

The attachment bracket 26 can also connect to an optional heater 87 via the same attachment process; however, the downrod 40 will connect to an extension pole 18 or directly into the female cap 90 located on the top of the light.

To turn these embodiments any direction, a hinge option 94. The hinge will allow the light 70, heater 87, television, and additional functional devices the ability to point the Universal Canopy Suspension System's connected embodiment toward the user.

There are multiple ways to connect the Universal Canopy Suspension System's bracket: ropes, tape, bungee cords, pin and clips, and the like are a few options. The bracket and its snap on embodiments are simple to assemble and functional.

FIG. 19 is another very simplistic method of design and connection of the bracket. The arms on the attachment bracket each have a hook. These hooks are similar to the wreath holders that can be installed above the door of a house. There are four hooks in FIG. 19; however there could be only one, two or more. This design of the Universal Canopy Suspension System's bracket allows the user to simply push the four hooks of the attachment bracket between the poles and up towards the canopy. Once the base of the hooks are above the canopy's poles, the attachment bracket can be twisted (counter clockwise with this CAD design) until the bracket is stopped by the canopy's poles. At this point the hook should be aligned so that one may release or pull down on the bracket locking it into place. This is a much easier method and keeps the hook and loop threading out of the picture.

The attachment bracket will connect faster to the canopy's poles and hold the bracket and its connected embodiment without issues.

The invention claimed is:

1. A suspension system comprising:

a bracket comprising:

a base having a base internal surface opposite a base external surface;

a hole defining a hole opening communicating between said base internal and external surfaces; and a plurality of elongate arms extending radially outward from said base; each said elongate arm including an upwardly extending coupler directly connected to said elongate arm, said upwardly extending coupler configured to couple to a pole which supports a canopy; and a downrod having opposing downrod first and second ends;

said downrod first end configured to couple to said base proximate said base internal surface when said downrod second end passes through said hole opening;

said downrod second end configured to couple to an auxiliary element.

2. The suspension system of claim 1, further comprising a ball joint coupled to said downrod first end, said ball joint configured to pivotally couple said downrod first end to said base proximate said base internal surface when said downrod second end passes through said hole opening.

3. The suspension system of claim 2, further comprising a pin extendable through a pair of bracket holes and a pair of ball joint holes to couple said ball joint to said bracket.

4. The suspension system of claim 1, wherein each of said plurality of elongate arms further comprises reinforcement ridges coupled to an elongate arm internal surface.

5. The suspension system of claim 4, wherein said ridges are configured as a waffle pattern of said ridges.

6. The suspension system of claim 1, wherein said upwardly extending coupler includes:

a pair of slits, each of said pair of slits longitudinally disposed within opposing elongate arm side walls; and a tether configured to pass through said pair of slits and extend about said pole which supports said canopy to couple said elongate arm to said pole which supports said canopy.

7. The suspension system of claim 6, wherein said tether is selected from the group consisting of: a hook and loop strap, rope, tape, a bungee cord, a pin, and a clip.

8. The suspension system of claim 1, wherein said upwardly extending coupled includes an arm hook upwardly extending which upwardly extends from said elongate arm, said arm hook configured to hook about said pole which supports said canopy to couple said elongate arm to said pole which supports said canopy.

9. The suspension system of claim 1, wherein each of said plurality of elongate arms further comprises a channel extending along an elongate arm length, said channel configured to receive said pole which supports said canopy.

10. The suspension system of claim 9, wherein said channel is configured as a u-shaped channel.

11. The suspension system of claim 1, wherein said auxiliary element includes a fan comprising:

a blade wheel;

a plurality of blades coupled to said blade wheel, said plurality of blades extending radially outward from said blade wheel; and a motor operable to rotate said plurality of blades about said blade wheel.

12. The suspension system of claim 11, wherein said blades removably couple to said blade wheel.

13. The suspension system of claim 11, wherein said blades are formed from a resiliently compressible material.

14. The suspension system of claim 13, wherein said resiliently compressible material is configured as foam.

15. The suspension system of claim 13, wherein said resiliently compressible material is coated in latex.

16. The suspension system of claim 11, wherein said fan further comprises a light.

17. The suspension system of claim 1, wherein said downrod second end is configured to interchangeably couple with a plurality of said auxiliary elements.

18. The suspension system of claim 17, wherein said plurality of auxiliary elements are selected from the group consisting of a fan, a light, a heater, a television mounting system, medical equipment, and an extension pole.

* * * * *